United States Patent [19]

Stewart

[11] 4,145,054

[45] Mar. 20, 1979

[54] GOLF SWING TRAINING AID

[76] Inventor: Phil D. Stewart, 2204 Bryson Rd., Boise, Id. 83702

[21] Appl. No.: 807,379

[22] Filed: Jun. 17, 1977

[51] Int. Cl.[2] ..... A63B 69/36

[52] U.S. Cl. ..... 273/186 A; 273/194 R

[58] Field of Search ..... 273/183 D, 186 A, 186 C, 273/194 R, 81.2, 165, 186 R

[56] References Cited

U.S. PATENT DOCUMENTS

| | | | |
|---|---|---|---|
| 760,161 | 5/1904 | Smith | 273/165 |
| 2,787,470 | 4/1957 | Barrus et al. | 273/186 A |
| 3,918,721 | 11/1975 | Trask | 273/186 A |
| 3,954,271 | 5/1976 | Tredway | 273/186 A |
| 4,023,812 | 5/1977 | Lorang | 273/186 A |

*Primary Examiner*—George J. Marlo
*Attorney, Agent, or Firm*—Eugene D. Farley

[57] ABSTRACT

A golf swing training aid comprises a rod attached to a golf club shaft in such a manner that it forms a laterally-spaced, angularly-directed bifurcation of the shaft. In its use it remains inoperative during a properly executed swing, but contacts the forearms of the golfer during an improperly executed swing thus advising him of his error. In its use position, the ends of the rod are in a plane extending through the club shaft and head, and the rod extends at an angle of 1° to 10° relative the club shaft. The rod is secured to the shaft by a piece of resiliently stiff material which is reversely bent to grip the rod and club shaft.

3 Claims, 10 Drawing Figures

GOLF SWING TRAINING AID

BACKGROUND AND GENERAL STATEMENT OF THE INVENTION

This invention pertains to golf swing training aids. It pertains particularly to golf swing training aids of the class adapted to be attached to golf club and for apprising the golfer of an incorrectly executed swing.

As is well known, the golf swing is a complicated maneuver difficult of execution in its seqential phases of back swing, down swing and follow through.

Many factors determine improper execution of the golf swing. Among these are improper pivoting, improper positioning of the elbows, improper cocking and rotation of the wrists and improper body motion.

I have discovered that the foregoing and other golf swing deficiencies may be detected, and accordingly corrected, by the provision on the golf club itself of a training aid which in effect is a laterally-spaced, angularly-directed golf club shaft extension or bifurcation. In the case of a properly executed swing, the aid remains between the forearms of the golfer out of contact therewith. In the case of an improperly executed swing, the aid nudges one or the other of the forearms and thus alerts the golfer to his improper execution of the swing.

The golf swing training aid of my invention essentially comprises a rod and attaching means for attaching the rod to the shaft of a golf club. The rod is of predetermined length and its angle of attachment is such as to cause it to remain out of contact with the forearms during a properly executed swing, but to contact one or the other of the forearms during an improperly executed swing.

It has many advantages, among which are the following:

It positively indicates an error in the swing so that there remains in the mind of the golfer no doubt that he has committed such an error.

It detects various types of errors including faulty wrist, arm and body movements during all phases of the swing, including the back swing, the down swing, and the follow through.

It is applicable to most of the various categories of golf clubs, especially the irons.

It attaches to a conventional club without modification of the club and without causing any damage to it.

It is easily portable and can be carried conveniently by the golfer in his golf club bag or cart.

It is easily attached to and detached from the golf club so that it may be used in conjunction with the golfer's customary playing clubs.

DESCRIPTION OF THE PREFERRED EMBODIMENT OF THE INVENTION

The golf swing training aid of my invention is described and illustrated herein with reference to the drawings wherein.

FIGS. 3 and 4, 5 and 6, and 7 and 8, are views illustrating the manner of use of my golf swing training aid and illustrating particularly the manner in which it operates to inform the golfer of an improperly executed swing.

Figure 1:
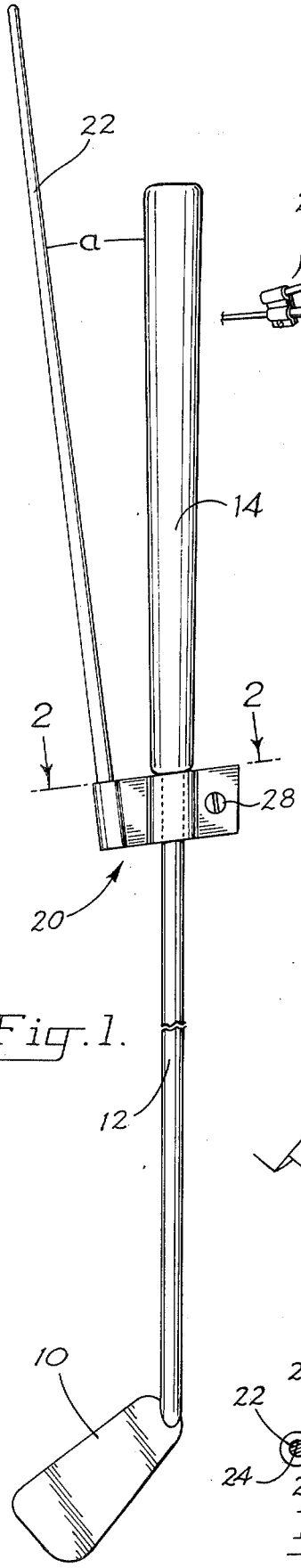
FIG. 1 is a foreshortened view in elevation of a golf club with my golf swing training aid mounted thereon.
Figure 9:
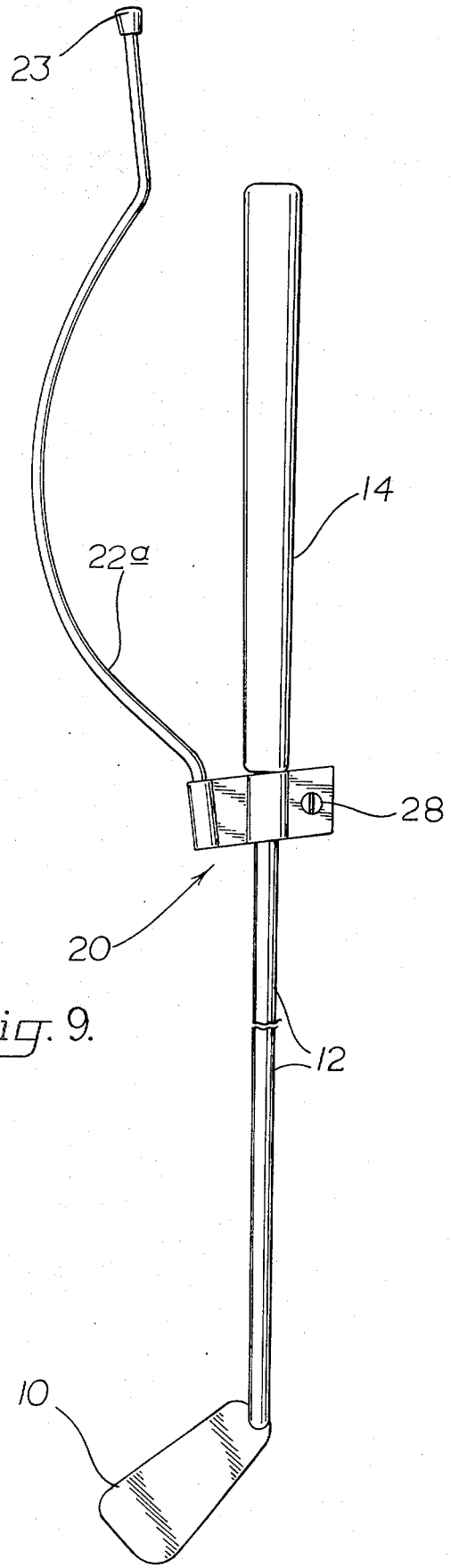

FIG. 9 is a foreshortened view in elevation, similar to FIG. 1, of a golf club with a modification of my golf swing training aid mounted thereon. This modification is designed to clear the hands of a golfer having hands of large size.

Figure 8:
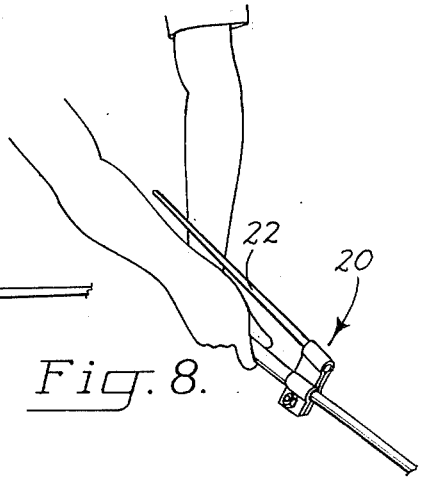
Figure 10:
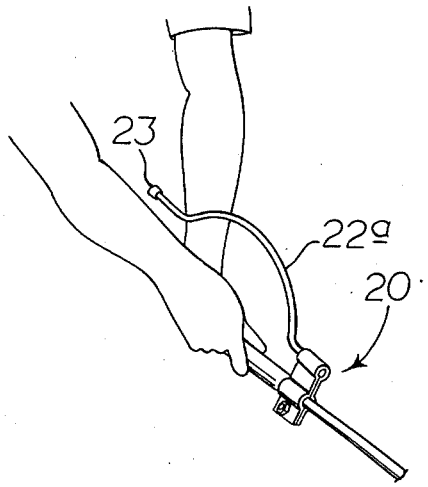

FIG. 10 is a view similar to FIG. 8 illustrating how the training aid modification of FIG. 9 clears the hands of the golfer as he makes his swing.

The hereindescribed golf swing training aid is adapted for use with any of various golf clubs, in particular the irons. Such clubs comprise the usual head 10, shaft 12, and grip or handle 14. As considered herein, the grip or handle 14 is deemed to be part of the shaft and to be comprehended within the meaning of that term.

The training aid is indicated generally at 20. Its active component is a tactile indicator in the form of a long, slim rod 22. The rod may be fabricated from various structural materials, preferably from flexible plastic with a rounded end so that in use it cannot scratch or bruise the golfer.

The rod may be straight, as is rod 22 of FIGS. 1–8, or it may be arcuate, as is rod **22*a* of FIGS. 9 and 10**. The degree of arc is predetermined to fit the rod to the hands of the golfer.

Also, the rod may be equipped with a cap piece 23, FIGS. 9 and 10, to protect the golfer's arms and also to increase the sensitivity of the aid.

Attaching means are provided for attaching the rod to the club as a laterally-spaced, angularly-directed extension of the shaft. The rod thus will extend beyond the handle portion of the shaft in a plane with respect to the handle which lies in the general plane of the club head with respect to the shaft.

In the illustrated form of the invention, the attaching means broadly cmprises a clamp which mounts the training aid on the shaft proper 12, on grip 14, or in the region lapping both of these club components. Socket means is provided on the clamp for mounting the rod in the desired position.

Figure 2:
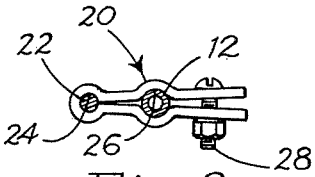
FIG. 2 is a transverse sectional view taken along lines 2—2 of FIG. 1.

Thus as seen particularly in FIG. 2, the combination clamp and socket comprises a reversely bent piece of resiliently stiff material, such as metal or plastic, shaped at its closed end into a socket 24. This socket is dimensioned to receive the base of rod 22 in a force fit. An adhesive joint may be employed if desired.

At its central portion the reversely bent piece of material forms a seat 26 for receiving adjustably and demountably the shaft or grip of the golf club.

At the open end of the reversely bent piece of material there is provided means for releasably clamping the piece to the club shaft or grip. In the illustrated embodiment, such means comprises a bolt 28.

It will be observed in FIG. 1 that seat 26 is aligned with the axis of the club shaft whereas socket 24 is at the slight angle "a" thereto. This determines the angle at which rod 22 lies to the club shaft.

This angle is important in determining the position of the tip of rod 22 with reference to the forearms of the golfer as he makes his shot. Although it will vary with such factors as the length of the rod and the angle of mounting, in general it will lie within the range of from 1° to 10°.

The net effect of these various factors is to locate the tip of the rod so that it will contact the golfer's forearm during an improperly executed golf swing, but will lie between the golfer's forearms and out of contact therewith during a properly executed golf swing.

This function of the rod is illustrated in FIGS. 3–8 of the drawings.

Figure 3:
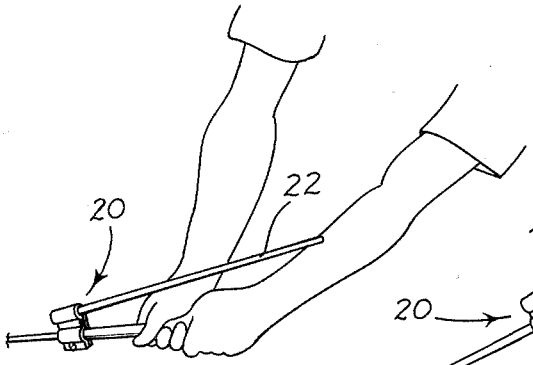
Figure 4:
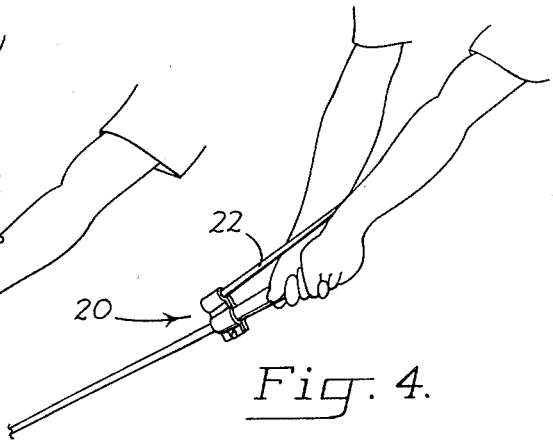

If the wrists are not rotated properly at the beginning of the back swing, the tip of rod 22 will poke the golfer's left forearm as shown n FIG. 3, alerting him of the defective back swing. However, if the wrists are rotated properly, the tip of the rod will lie between the golfer's forearms out of contact therewith, as shown in FIG. 4.

Figure 5:
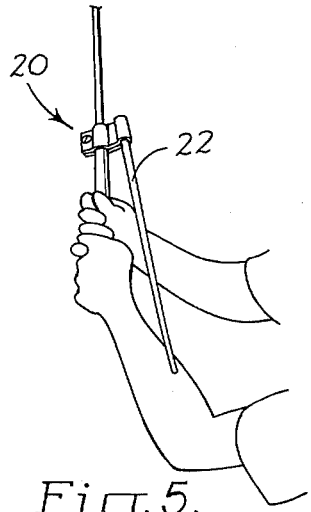
Figure 6:
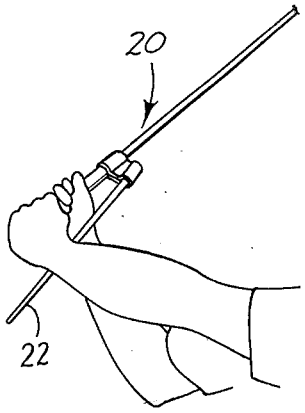

If during the back swing or down swing the golfer cocks his wrists improperly, the tip of rod 22 will poke his left forearm as shown n FIG. 5. However, if cocking of the wrists is executed properly, the rod will move between the forearms of the golfer without contacting them.

Figure 7:
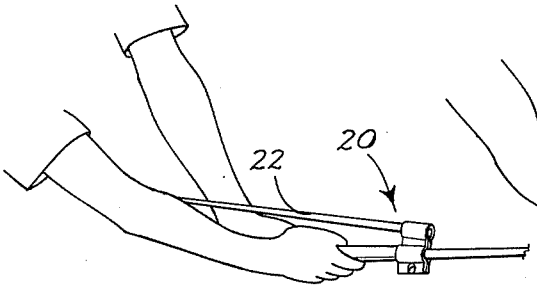

If the golfer bends his wrist improperly on the follow through, rod 22 will contact his right forearm as shown n FIG. 7. However, if the wrists roll closed properly during the follow through, resulting in full value of the shot, the rod remains clear of both forearms.

If the golfer has large hands, they will be accommodated by the rod if the rod is of arcuate contour, as shown in FIGS. 9 and 10.

Thus by the present invention I have provided a simple device which alerts the golfer positively and decisively to any imperfection of his golfing swing.

Having described my invention in preferred embodiments, I claim:

1. In combination with a golf club having a golf head and a shaft extending from the golf head for gripping in the hands of a golfer, a golf swing training aid comprising:

a. an elongated rod, and b. attaching means for attaching the rod to the golf club shaft for disposition of the rod ends in a plane extending through the shaft and golf head and for extension of the rod rearwardly over the hands of the golfer beyond the end of said shaft and for termination of the rod at its rearward end in a position between and out of contact with the forearms of the golfer during the back swing, down swing and follow through of a properly executed golf swing and for contact with the forearms of the golfer during an improperly executed golf swing.

2. The combination of claim 1 wherein the longitudinal axis of the rod forms with the longitudinal axis of the shaft an included angle of from 1° to 10°.

3. In combination with a golf club including a golf head and shaft, a golf swing training aid comprising:

a. a rod, and b. attaching means for attaching the rod to the golf club shaft, the angle of attachment of the rod and its length being predetermined to cause the rod to contact the golfer's forearm during an improperly executed golf swing and to lie between the golfer's forearms and out of contact therewith during a properly executed golf swing, the attaching means comprising a reversely bent piece of resiliently stiff material shaped at its closed end into a socket dimensioned to receive the rod and at its central portion with a seat dimensioned to receive the golf club shaft, the longitudinal axis of the socket forming with the longitudinal axis of the seat an included angle of from 1° to 10°, and mounting at its open end releasable securing means for releasably securing the ends of the piece in clamping engagement with the golf club shaft.

* * * * *